US007746328B2

(12) United States Patent
Chen et al.

(10) Patent No.: US 7,746,328 B2
(45) Date of Patent: Jun. 29, 2010

(54) DISPLAY DRIVING CIRCUIT AND A DISPLAY APPARATUS USING THE DISPLAY DRIVING CIRCUIT AND THE METHOD THEREOF

(75) Inventors: Kuei-Hsiang Chen, Sinhua Township, Tainan County (TW); Yao-Hwei Lee, Sinhua Township, Tainan County (TW); Ying-Chou Tu, Sinhua Township, Tainan County (TW)

(73) Assignee: Himax Technologies Limited, Tainan County (TW)

( * ) Notice: Subject to any disclaimer, the term of this patent is extended or adjusted under 35 U.S.C. 154(b) by 1190 days.

(21) Appl. No.: 10/947,375

(22) Filed: Sep. 23, 2004

(65) Prior Publication Data

US 2005/0073493 A1 Apr. 7, 2005

(30) Foreign Application Priority Data

Oct. 7, 2003 (TW) ..... 92127908 A

(51) Int. Cl.
*G09G 5/00* (2006.01)

(52) U.S. Cl. ..... 345/204

(58) Field of Classification Search ..... 345/1–3, 345/99, 87, 100, 204, 213, 89, 98, 211
See application file for complete search history.

(56) References Cited

U.S. PATENT DOCUMENTS 5,568,284 A * 10/1996 Oku et al. ..... 358/518
6,271,822 B1 * 8/2001 Chiang ..... 345/99
2004/0036708 A1 * 2/2004 Evanicky et al. ..... 345/691

FOREIGN PATENT DOCUMENTS

JP 07-175447 * 7/1995
JP 2001-201732 * 7/2001

* cited by examiner

*Primary Examiner*—Richard Hjerpe
*Assistant Examiner*—Shaheda A Abdin
(74) *Attorney, Agent, or Firm*—Rabin & Berdo, P.C.

(57) ABSTRACT

A display driving circuit including a color correction unit and a driving unit is provided. The color correction unit receives a digital video signal and a polarity signal, and outputs a color corrected video signal according to the received digital video signal and the polarity signal, wherein the polarity signal represents the polarity of the driving polarity applied on the display apparatus. The driving unit receives a color corrected video signal and accordingly has the received color corrected video signal converted into an analog driving voltage. The display apparatus displays the frame on the display panel according to the received analog driving voltage.

9 Claims, 3 Drawing Sheets

DISPLAY DRIVING CIRCUIT AND A DISPLAY APPARATUS USING THE DISPLAY DRIVING CIRCUIT AND THE METHOD THEREOF

This application claims the benefit of Taiwan application Serial No. 92127908, filed Oct. 07, 2003, the subject matter of which is incorporated herein by reference.

BACKGROUND OF THE INVENTION

1. Field of the Invention

The invention relates in general to a display apparatus, and more particularly to a display driving circuit and the method thereof.

2. Description of the Related Art

A display apparatus, which converts digital video signals of a computer into a visually recognizable image, serves as an interface between a user and a computer. FIG. 1 is a block diagram of a familiar display apparatus. Display apparatus 100 uses a liquid crystal display apparatus as an example here. The display apparatus 100 includes a display driving circuit 110 and a display panel 180. The display driving circuit 110 includes a color correction unit 120, a data inversion unit 140 and a driving unit 160. The color correction unit 120 receives a digital video signal PD and performs color correction on the digital video signal PD, then outputs the color corrected video signal PD' to the data inversion unit 140. The data inversion unit 140 either selectively inverts or maintains the color corrected video signal PD', then outputs a polarity digital video signal PD" accordingly. After receiving the polarity digital video signal PD", the driving unit 160 performs digital-to-analog inversion on polarity digital video signal PD", then outputs an analog driving voltage Vpd. After that, the display panel 180 displays a frame on the display panel according to the analog driving voltage Vpd.

Color correction is for correcting the characteristics of the inputted digital video signals to achieve a better color quality when the digital video signals are displayed on the frame. Take the liquid crystal display panel for example: the relationship between the gray value of an ordinary liquid crystal display panel and the driving voltage is non-linear, so color correction is needed. The non-linear curve is also called a 'color corrected curve' or a 'gamma curve', while the 'color correction' is also called 'gamma correction'.

FIG. 2 is a diagram of a familiar color corrected curve. The x-axis is the inputted digital video signal PD while the y-axis is the outputted color corrected video signal PD'. The digital video signal PD generates a corresponding color corrected video signal PD' in accordance with the color corrected curve. The driving unit 160 outputs an analog driving voltage Vpd according to the received color corrected video signal PD' so that the display panel 180 displays a correct frame on the display panel.

The liquid crystal molecules of a liquid crystal display apparatus will be easily electrically inferior when exposed to the driving voltage of the same polarity for long. To resolve the inferiority problem, a familiar technology uses the positive driving voltage alternating with the negative driving voltage to drive the liquid crystal molecules. The data inversion unit 140 is for determining the driving polarity of the polarity video signal PD". After having been processed by the driving unit 160, the positive video signal PD" is outputted as a positive analog driving voltage Vpd, while the negative digital video signal PD" is outputted as a negative analog driving voltage Vpd.

SUMMARY OF THE INVENTION

It is therefore an object of the invention to provide a display driving circuit and a display apparatus using the display driving circuit and the method thereof.

It is another object of the invention to provide a display driving circuit including a color correction unit and a driving unit. By means of a table-look-up method, the color correction unit generates a color corrected video signal according to a digital video signal and a polarity signal. The driving unit performs digital-to-analog conversion on the color corrected video signal and outputs an analogous driving voltage, wherein the driving polarity of the analogous driving voltage corresponds to the polarity signal.

According to another object of the invention, a display apparatus is provided, wherein the display apparatus, which displays a frame according to a digital video signal, includes a color correction unit, a driving unit and a display panel. By means of a table-look-up method, the color correction unit generates a color corrected video signal according to a digital video signal and a polarity signal. The driving unit performs digital-to-analog conversion on the color corrected video signal and outputs an analogous driving voltage accordingly. The display panel displays a frame according to the analogous driving voltage. Of which, the display panel includes a liquid crystal display panel; the driving polarity that the analogous driving voltage applies on the liquid crystal panel corresponds to the polarity signal.

It is another object of the invention to provide a method of driving a liquid crystal display to display an image; the method includes the steps of receiving a digital video signal and a polarity signal; generating a color corrected video signal according to the digital video signal and the polarity signal by means of a table-look-up method; converting the color corrected video signal into an analogous driving voltage; and using the analogous driving voltage to drive the liquid crystal display. Of which, the driving polarity of the analogous driving voltage corresponds to the polarity signal.

Other objects, features, and advantages of the invention will become apparent from the following detailed description of the preferred but non-limiting embodiments. The following description is made with reference to the accompanying drawings.

DETAILED DESCRIPTION OF THE INVENTION

Preferred Embodiment One

Figure 1:
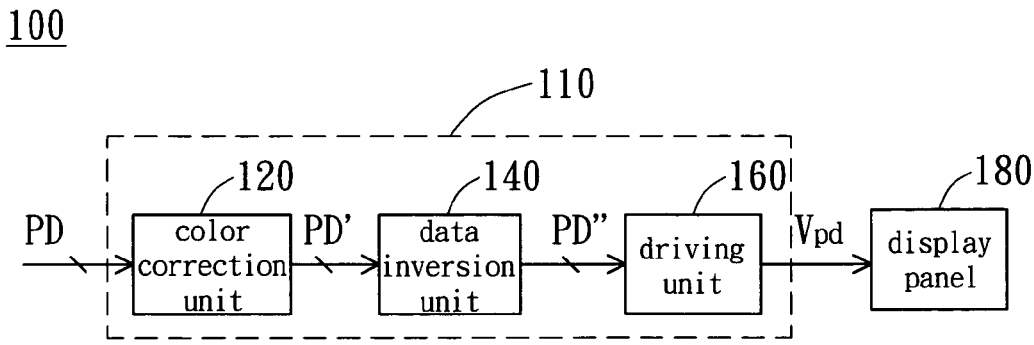
FIG. 1(PRIOR ART)
FIG. 1 (prior art) is a block diagram of a familiar display apparatus.
Figure 2:
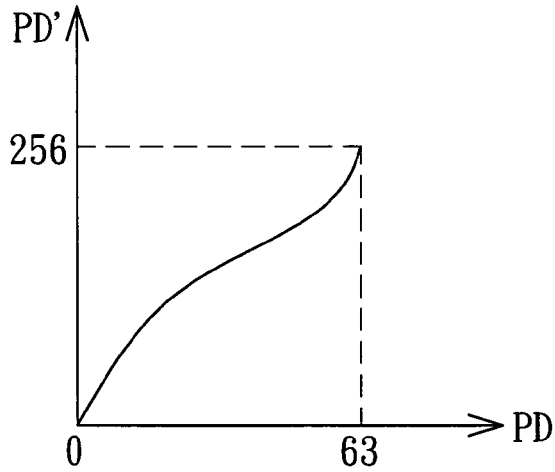
FIG. 2(PRIOR ART)
FIG. 2 (prior art) is a diagram of a familiar color corrected curve.
Figure 3:
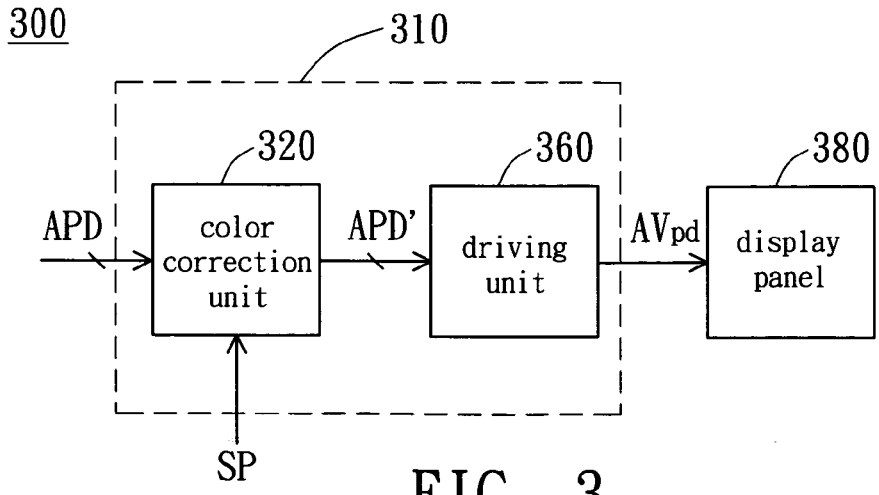
FIG. 3 is a block diagram of a display apparatus according to preferred embodiment one of the invention.

Referring to FIG. 3 is a block diagram of a display apparatus according to preferred embodiment one of the invention is shown. Display driving circuit 310 receives a digital video signal APD and accordingly generates a driving voltage AVpd to drive the pixels of a display panel 380 to display a frame. The display driving circuit 310 includes a color correction unit 320 and a driving unit 360. The color correction unit 320 receives a digital video signal APD and a polarity signal Sp to perform color correction according to the digital video signal APD and the polarity signal Sp. The color correction unit 320 outputs the result of color correction as a color corrected video signal APD', wherein the polarity signal Sp represents the driving polarity of the driving voltage AVpd outputted by the driving unit 160. The polarity of the driving voltage does not mean that the driving voltage AVpd is a positive voltage or a negative voltage, but rather refers to the polarity of the voltage difference between the pixel electrode and the common electrode when the driving voltage AVpd is applied. The driving unit 360 is electrically connected to the color correction unit 320 for receiving a color corrected video signal PD', performing a digital-to-analog conversion on the color corrected video signal PD' and outputting a driving voltage AVpd accordingly.

The digital video signal APD may remove at least one least significant bit, then, when combined with a polarity signal Sp, becomes an input signal of the color correction unit 320. Take an 8-bit digital video signal APD[7:0] for example. When two least significant bits are removed, the 8-bit digital video signal APD[7:0] becomes an APD[5:0], which, when combined with a 1-bit polarity signal Sp, serves as an input signal of the color correction unit 320. When the polarity signal Sp equals 0, a positive polarity is implied; when the polarity signal Sp equals 1, a negative polarity is implied; or the other way round. Besides, the color correction unit 320 generates a color corrected video signal APD' by means of a table-look-up method. The color correction unit 320 includes a look-up table containing the relationship of a digital video signal APD, a polarity signal Sp and a color corrected video signal APD'.

The display apparatus 300 includes a driving circuit 310 and a display panel 380. The display driving circuit 310 outputs a driving voltage AVpd to the display panel for displaying a frame. The driving unit 360 includes a digital-to-analog converter for performing digital-to-analog conversion.

Figure 4:
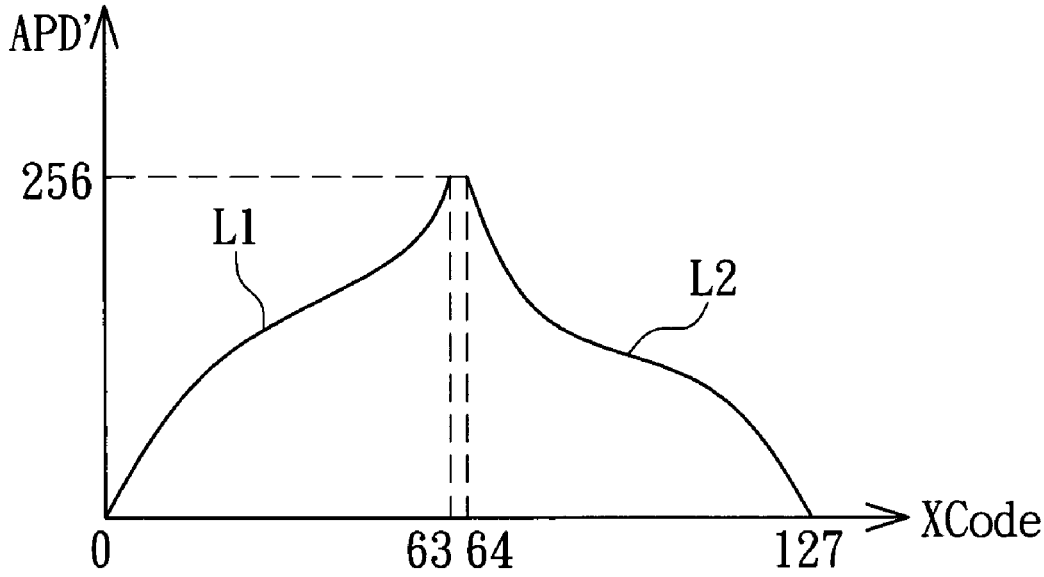
FIG. 4 is a color corrected curve of a polarized color correction unit.

Referring to FIG. 4, a color corrected curve of a polarized color correction unit is shown. The x-axis is a combined signal XCode of a polarity signal Sp and a digital video signal APD[5:0]. That is to say, when Sp equals 0 and represents a positive polarity, the combined signal XCode ranges from 0 to 63 and has the same value with APD[5:0]; when Sp equals 1 and represents a negative polarity, the value of the combined signal XCode falls within the interval of 64 to 127 and is equal to that of APD[5:0] plus a shift quantity of 64. The y-axis is an 8-bit color corrected video signal APD'. If the value of the combined signal falls within the interval of 0 to 63, the color correction unit 320 will generate a corresponding color corrected video signal APD' according to a positive color corrected curve L1; if the value of the combined signal falls within the interval of 64 to 127, the color correction unit 320 will generate a corresponding color corrected video signal APD' according to a negative color corrected curve L2. Due to the characteristics of the liquid crystal, symmetric relationship does not necessary exist between the positive color corrected curve L1 and the negative color corrected curve L2. For example, the two color corrected curves illustrated in FIG. 4 are not symmetric. The conversion relationship between the combined signal XCode and the color corrected video signal APD' illustrated in FIG. 4 is merely shown as an example of a preferred embodiment of the invention. In practical application, the polarity signal Sp may become any one bit of the combined signal XCode. However, this will change the conversion relationship between the combined signal XCode and the color corrected video signal APD'. Thus the color correction unit 320 according to a preferred embodiment of the invention includes a look-up table containing the relationship of a combined signal XCode and a color corrected video signal APD'.

Preferred Embodiment Two

Figure 5:
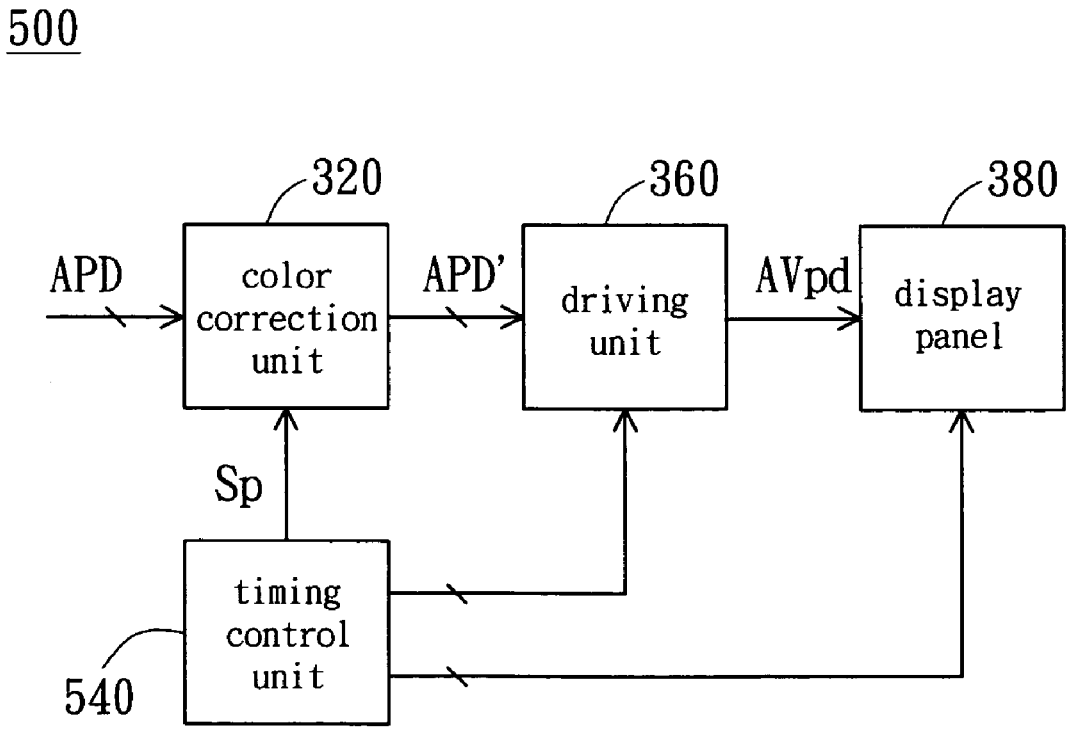
FIG. 5 is a block diagram of a display apparatus according to preferred embodiment two of the invention.

Referring to FIG. 5, a block diagram of a display apparatus 500 according to preferred embodiment two of the invention is illustrated. To simplify the explanation of the preferred embodiments of the invention, the same elements are labeled the same and are not repeated here. The present preferred embodiment differs from the previous preferred embodiment in that the former further includes a timing control unit 540 providing a necessary timing signal to control the operation of the color correction unit 320, the driving unit 360 and the display panel 380. While the timing control unit 540 may be integrated in an integrated circuit with the color correction unit 320 according to a preferred embodiment of the invention or may be integrated in an integrated circuit with, the driving unit 360 and the color correction unit 320 according to another preferred embodiment of the invention, the driving unit 360 may also be integrated in an integrated circuit with the color correction unit 320.

Preferred Embodiment Three

Figure 6:
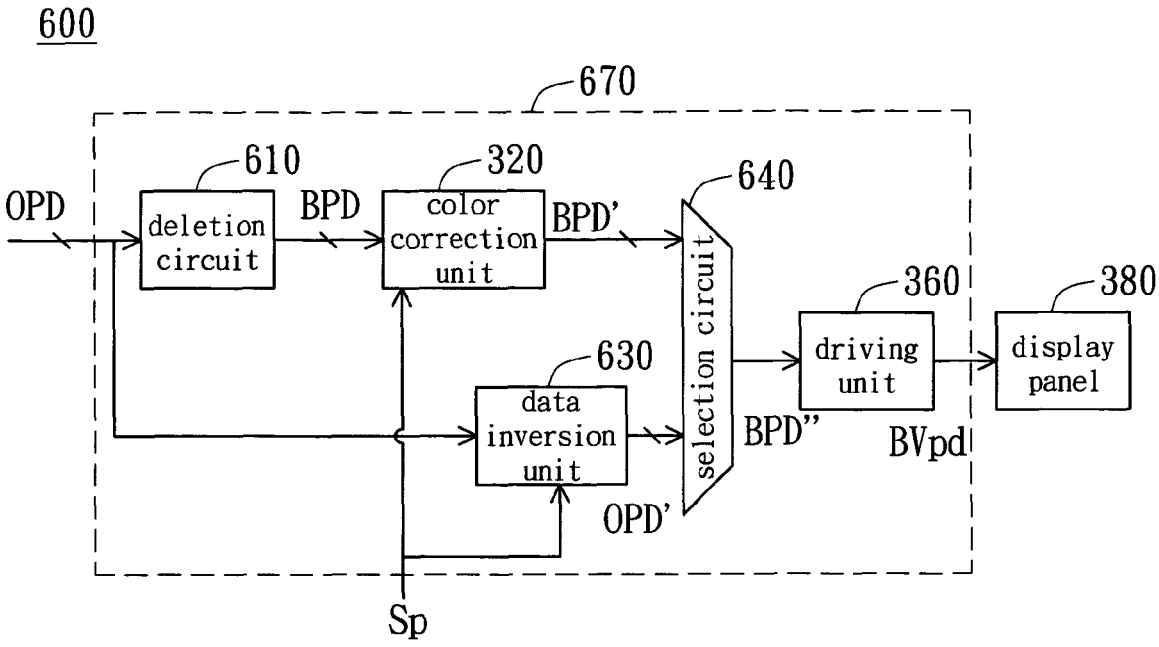
FIG. 6 is a block diagram of a display apparatus according to preferred embodiment three of the invention.

Referring to FIG. 6, a block diagram of a display apparatus 600 according to preferred embodiment three of the invention is illustrated. To simplify the explanation of the preferred embodiments of the invention, the same elements are labeled the same and are not repeated here. Display driving circuit 670 includes a deletion unit 610, a color correction unit 320, a data inversion unit 630, a selection unit 640 and a driving unit 360. The deletion unit 610 receives a digital video signal OPD and removes at least one least significant bit from the digital video signal OPD to generate an after-deletion digital video signal BPD. Take an 8-bit digital video signal APD [7:0] for example. When two least significant bits are removed, the 8-bit digital video signal APD[7:0] becomes an after-deletion digital video signal BPD[5:0]. After receiving the digital video signal BPD and the polarity signal Sp, the color correction unit 320 performs color correction and outputs a color corrected video signal BPD' accordingly.

The data inversion unit 630 selectively inverts or maintains a digital video signal OPD to generate a polarity digital video signal OPD' according to a polarity signal Sp. When the polarity signal Sp equals 0, the polarity digital video signal OPD' is the same with the digital video signal OPD; when the polarity signal Sp equals 1, the polarity digital video signal OPD' is the one's compliment of the digital video signal OPD; or the other way round. Another preferred embodiment of the invention may use a switch or a control signal (not shown here) to select one from the deletion unit 610 and the data inversion unit 630 to receive the digital video signal OPD.

In accordance with system requirements, the selection circuit 640, which includes a multiplexer, receives a color corrected video signal BPD' and a polarity digital video signal OPD' and selects one from the color corrected video signal BPD' and the polarity digital video signal OPD' to be outputted as a display digital video signal BPD" to the driving unit 360. The driving unit 360 will generate an analog driving voltage BVpd according to the display digital video signal BPD".

The display apparatus 600 includes a display driving circuit 670 and a display panel 380. The display driving circuit 670 outputs a driving voltage BVpd to display a frame on the display panel 380.

Preferred Embodiment Four

Figure 7:
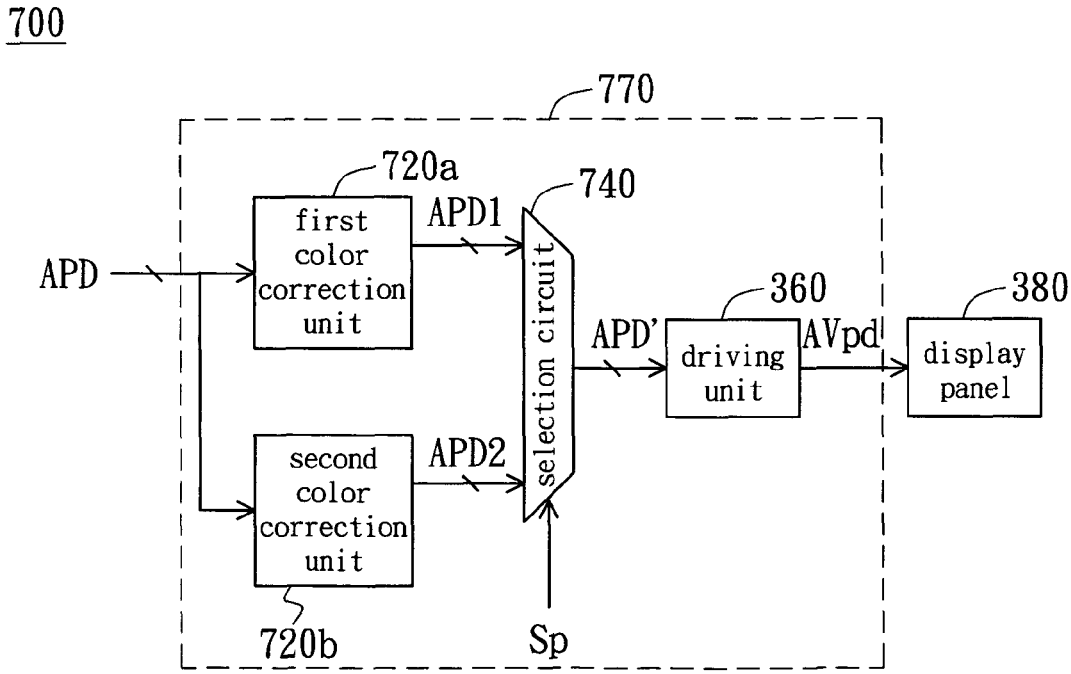
FIG. 7 is a block diagram of a display apparatus according to preferred embodiment four of the invention.

Referring to FIG. 7, a block diagram of a display apparatus 700 according to preferred embodiment four of the invention is illustrated. To simplify the explanation of the preferred embodiments of the invention, the same elements are labeled the same and are not repeated here. Display driving circuit 770 includes a first color correction unit 720*a*, a second color correction unit 720*b*, a selection circuit 740 and a driving unit 360. The first color correction unit 720*a* stores a look-up table of positive polarity color correction, while the second color correction unit 720*b* stores a look-up table of negative polarity color correction. The digital video signal APD performs positive polarity color correction via the first color correction unit 720*a* to output a positive polarity color corrected video signal APD1, but performs negative polarity color correction via the second color correction unit 720*b* to output a negative polarity color corrected video signal APD2. The selection circuit 740 selects one from the positive polarity video signal APD1 and the negative polarity video signal APD2 to be outputted as a color corrected video signal APD'. Thus according to preferred embodiment four of the invention, different color correction may be achieved to meet with different polarity requirement without performing data inversion or polarity inversion on any digital video signal.

Conventionally, the function of the color correction unit and that of the data inversion unit are separated. A preferred embodiment according to the invention integrates the two functions, which are conventionally separated. With a look-up table instruction, different color correcting functions of digital video signals of different polarities may be completed at the same time, thereby simplifying the design of chips and reducing both chip size and manufacturing costs.

The color correction unit according to a preferred embodiment of the invention may perform different digital color correction according to the characteristic of a digital video signal. Take the liquid crystal monitor for example. The gray value of a pixel does not form a simple linear relationship with the driving voltage, so the digital video signal needs to be color corrected to obtain a correct driving voltage. Theoretically, applying driving voltages of the same quantity but of different polarities on a liquid crystal monitor should produce the same gray value. In reality, the gray values produced by driving voltages of the same quantity but of different polarities are still somewhat different. Conventionally, a driving IC is polarized after having been color corrected, so color correction of different types cannot be performed according to what polarity type the video signal is. The invention has two asymmetric curves, positive color corrected curve L1 and negative color corrected curve L2, so the two asymmetric curves L1 and L2 may be designed in accordance with the characteristics of the display panel to improve the quality of the frame displayed on a display apparatus.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A display driving circuit for receiving an n-bit digital video signal, comprising:

a color correction unit, which removes at least one least significant bit of the n-bit digital video signal to generate an m-bit signal, generates a combined signal according to the m-bit digital video signal and a polarity signal, and generates an n-bit color corrected video signal using a table look-up method according to the combined signal, wherein the combined signal is equal to the m-bit digital video signal if the polarity signal represents a positive polarity and the combined signal is equal to the m-bit digital video signal plus a constant shift quantity if the polarity signal represents a negative polarity, where m and n are positive integers and m is smaller than n; and a driving unit, which performs digital-to-analog conversion on the color corrected video signal.

2. The display driving circuit according to claim 1, wherein the driving unit outputs an analogous driving voltage.

3. The display driving circuit according to claim 2, wherein the driving polarity of the analogous driving voltage corresponds to the polarity signal.

4. The display driving circuit according to claim 1, wherein the display driving circuit further comprises a timing control unit providing the display driving circuit with a necessary timing signal.

5. A method of driving a liquid crystal display to display an image, comprising the steps of:

receiving an n-bit digital video signal and a polarity signal;

removing at least one least significant bit of the n-bit digital video signal to generate an m-bit digital video signal, where n and m are positive integers and m is smaller than n;

generating a combined signal according to the m-bit digital video signal and the polarity signal, wherein the combined signal is equal to the m-bit digital video signal if the polarity signal represents a positive polarity and the combined signal is equal to the m-bit digital video signal plus a constant shift quantity if the polarity signal represents a negative polarity;

generating a corresponding n-bit color corrected video signal using a table look-up method according to the combined signal;

converting the color corrected video signal into an analogous driving voltage; and using the analogous driving voltage to drive the liquid crystal display, wherein the driving polarity of the analogous driving voltage corresponds to the polarity signal.

6. The method according to claim 5, wherein the table look-up step has a look-up table comprising the combined signal and the color corrected video signal.

7. A method of driving a liquid crystal display to display an image, comprising the steps of:

receiving an n-bit digital video signal and a polarity signal;

removing at least one least significant bit of the n-bit digital video signal to generate an m-bit digital video signal, where n and m are positive integers and m is smaller than n;

enabling the m-bit digital video signal to have a driving polarity characteristic to generate a polarity digital signal according to the polarity signal, wherein the polarity digital signal is equal to the m-bit digital video signal if the polarity signal represents a positive polarity and the polarity digital signal is equal to the m-bit digital video signal plus a constant shift quantity if the polarity signal represents a negative polarity;

performing color correction using a table look-up method to generate a corresponding n-bit color corrected video signal according to the polarity digital signal;

converting the color corrected video signal into an analogous driving voltage; and using the analogous driving voltage to drive the liquid crystal display.

8. The display driving circuit according to claim 1, wherein the polarity signal is one bit of the combined signal.

9. The display driving circuit according to claim 1, wherein the constant shift quantity is $2^m$.

* * * * *